United States Patent [19]

Sasaki et al.

[11] Patent Number: 4,576,344

[45] Date of Patent: Mar. 18, 1986

[54] POLYESTER FILM ROLL

[75] Inventors: Ichitaro Sasaki, Izumi; Takashi Mori; Tadao Tsuyuguchi, both of Ogaki, all of Japan

[73] Assignee: Teijin Limited, Osaka, Japan

[21] Appl. No.: 756,920

[22] Filed: Jul. 18, 1985

Related U.S. Application Data

[63] Continuation of Ser. No. 633,082, Jul. 23, 1984, abandoned, which is a continuation-in-part of Ser. No. 372,842, Apr. 29, 1982, abandoned.

[30] Foreign Application Priority Data

May 6, 1981 [JP] Japan ..... 56-66937
Mar. 9, 1982 [JP] Japan ..... 57-35760

[51] Int. Cl.[4] ..... B65H 18/10; B65H 18/16

[52] U.S. Cl. ..... 242/67.1 R; 242/68.5; 242/65; 242/75.1

[58] Field of Search ..... 242/55, 68.5, 67.1 R, 242/75.1, 65, 66, 75.2

[56] References Cited

U.S. PATENT DOCUMENTS 3,737,030 6/1973 Stewart ..... 242/68.5
4,150,797 4/1979 Kataoka ..... 242/67.1 R

*Primary Examiner*—John M. Jillions
*Attorney, Agent, or Firm*—Burgess, Ryan & Wayne

[57] ABSTRACT

A polyester film roll free from wrinkles over a long period of storage consists of a polyester film having a thickness of 25 microns or less and a centerline average surface roughness of from 0.001 to 0.05 microns and is characterized in that the roll hardness (H) and the centerline average surface roughness (Ra) of the film roll satisfy the relationship (I):

$$H \geqq 0.67x^3 - 10.61x^2 + 55.54x - 1.16 \quad \text{(I)}$$

wherein $x = ln\ (1/Ra)$, which film roll can be produced by means of a surface-center-winding method or a surface-winding method wherein the surface of the film roll is pressed with a touch roll.

2 Claims, 1 Drawing Figure

POLYESTER FILM ROLL

This application is a continuation of application Ser. No. 633,082, filed July 23, 1984, now abandoned, which is a continuation-in-part of application Ser. No. 372,842 filed Apr. 29, 1982, now abandoned.

FIELD OF THE INVENTION

The present invention relates to a polyester film roll and a method for producing the same. More particularly, the present invention is relates to a polyester film roll which remains stable in configuration over a long period of storage and a method for producing the same.

BACKGROUND OF THE INVENTION

It is well-known that a synthetic polymer film, for example, polyester film, can be wound on a core to form a film roll by means of a center-winding method or a surface-winding method.

In the center-winding method, a core is put on a winding drum which is driven at a predetermined speed and the film is wound on the core by driving the winding drum. In this method, usually, nothing comes into contact with the surface of the film which is being wound. Sometimes a touch roll, which is rotatable around a center shaft thereof, is placed on the surface of the film on the winding drum so as to press the film.

In the surface-winding method, a rotation drum is driven at a predetermined speed and a winding drum, which is rotatable around a center shaft thereof and which is covered with a core, is placed on the rotation drum in such a manner that the peripheral surface of the core on the winding drum comes into contact with the peripheral surface of the rotation drum and the core on the winding drum is rotated by the rotation drum due to the friction created between the core surface or the resultant film roll surface and the rotation drum surface.

In another method, the film may be wound to form a film roll by means of the surface-center-winding method, which has the advantages of both the surface-winding method and the center-winding method. In the surface-center-winding method, a winding drum is directly driven in the same manner as that of the center-winding method, and a touch roll is placed on the film roll formed on the winding roll so as to press the surface of the film roll. The touch roll is rotatable around the center shaft thereof and is driven due to the friction created between the peripheral surface of the touch roll and the surface of the film roll on the winding drum. The touch roll is effective for stabilizing the winding procedure of the film due to the pressing action thereof and for causing the resulting film roll to exhibit a satisfactory configuration.

When a polyester film is wound by means of the above-mentioned winding methods, the film is wound together with air accompanying the film surface. That is, the resultant film roll contains layers of air formed between the layers of film. Therefore, it is important to control the amount of air contained in the film roll to within an adequate range. Generally, if the amount of air is excessively large, the friction between the layers of film is significantly reduced. The reduced friction allows the film layers to easily move in a zigzag lateral direction and, therefore, the side faces of the resultant film roll become rough. This phenomenon is so-called "side face deviation".

If the film in the film roll shrinks due to the inherent shrinking property thereof, the winding is spontaneously compressed so that the air contained between the layers of film is removed through the side surfaces of the film roll and the inner portion of the film roll is deformed due to the shrinking force of the outer portion of the film roll.

If the amount of air contained in the film roll is excessively small and if the thickness of the film is uneven in the lateral direction thereof, a thick portion of the film forms a belt-shaped protuberance on the periphery of the resultant film roll. This phenomenon results in roughening of the film surface and causes the film surface to exhibit decreased physical properties.

Accordingly, in the winding procedure for producing a film roll, it is important that the amount of air in the air layers formed between the layers of film superimposed on each other be adequate.

When the film roll is formed by means of the center-winding method, the air in the air layers is often present in an excessively large amount. In this case, the amount of air in the air layers can be controlled merely by controlling the amount of winding tension to be applied to the film. If the amount of winding tension applied to the film is too small, it is impossible to reduce the amount of air in the air layer. Also, if the amount of winding tension is excessively large, the film is wrinkled just before it is introduced into the film roll and therefore wrinkled film is introduced into the film roll.

In the surface-winding method, it is necessary to keep the pressure between the peripheral surfaces of the rotation drum and the film roll constant so as to stabilize the rotation of the rotation drum. However, when the diameter of the resultant film roll becomes large, it is difficult to keep the pressure applied the surface of the film roll constant because of deviation in load on the rotation drum, which deviation in load is derived from a disturbance which cannot be controlled. Generally, the amount of air in the air layers formed between the layers of film is variable depending on the pressure applied to the surface of the film roll. Accordingly, in the case of the surface-winding method, it is very difficult to control the amount of air in the air layers.

However, in the case of the surface-center-winding method wherein the film roll is formed around a winding roll and the surface of the film roll is pressed with a touch roll, the amount of air in the air layers formed between the wound film layers can be controlled by controlling the surface property of the touch roll and/or the pressure derived from the touch roll. This is a benefit of the surface-center-winding method.

Due to the above-mentioned benefit, the surface-center-winding method is mostly utilized in a slit-winding apparatus by which a film is slit to a predetermined width and then is wound up to form a film roll.

In the recent winding-up technique for a film roll, it is important to control the amount of air in the air layers formed between the wound film layers. That is, the amount of air in the air layers is adjusted to a desired number on the basis of the brand of the film roll. Also, in the recently developed technology for producing polyester film, substantially no inequality in thickness is present in the polyester film. Accordingly, in the recent echnology for forming a film roll by using a slit-winding apparatus, it is important that the resultant film roll exhibit a satisfactory stability in configuration over a long period of storage. The stability in configuration of the film roll can be ensured by controlling the amount of air in the air layers in the film roll.

Usually, when a polyester film roll is stored over a long period of time, moisture in the atmosphere is gradually absorbed by the film roll through the peripheral surface and side surfaces of the film roll. The absoption of moisture results in the slight elongation of the film. This elongation causes the formation of wrinkles in the wound film layers in the film roll. Usually, wrinkles form a few days after the film roll is formed. Also, wrinkles frequently form in the case of a film roll consisting of a polyester film having an excellent smoothness of the surface thereof.

In the case of the conventional polyester film roll consisting of a polyester film having a thickness of 25 microns or less, especially 16 microns or less, and a centerline average surface roughness of 0.05 microns or less, it is very difficult to prevent the formation of wrinkles on the film by controlling the winding procedure wherein the air layers are necessarily formed between the wound film layers. That is, even when the winding tension to be applied to the film or the pressure to be created by the touch roll is strictly controlled in consideration of the brand of film to be wound up, it is difficult to prevent the formation of wrinkles because the manner of formation of wrinkles is unknown. Even if a film roll having no wrinkles is obtained, it is impossible to reproduce a film roll having no wrinkles since it is not clear how to prevent the formation of wrinkles. Accordingly, when the conventional film roll is shipped, it is impossible to guarantee that no wrinkles will form over a long period of storage.

As stated above, in the conventional technology, it is impossible to provide a polyester film roll which is completely free from the formation of wrinkles over a long period of storage. That is, when the conventional polyester film roll is exposed to the ambient air, wrinkles form in the film roll in approximately one week. In some cases, wrinkles form in approximately half of the outer portion of the film roll in a radial direction. The portion of the film having wrinkles is useless and, therefore, the film roll must be unwound and the portion of the film having wrinkles must be removed. Accordingly, the film roll having wrinkles has a poor commercial value.

Therefore, the inventors of the present invention considered that a polyester film roll which is free from the formation of wrinkles should be produced in consideration of the surface condition of the polyester film and the roll hardness of the film roll. On the basis of the above-mentioned consideration, the film roll of the present invention was created.

As stated hereinbefore, the touch roll used in the surface-center-winding method is effective for controlling the pressure to be applied to the surface of the film roll formed around the winding drum. Control of the pressure is effective for controlling the amount of air in the air layers in the film roll. The touch roll is usually coated with a rubber material, for example, NBR, EPT, polyurethane rubber or silicone rubber. Hitherto, the type of rubber material was selected in consideration of the purpose and manner of using the touch roll. However, the criterion for adjusting the hardness of the rubber material to be used to form the peripheral surface layer of the touch roll was not clear. Accordingly, the hardness of the rubber material for producing the touch roll was selected in consideration of the molding property and the resistance to scratching of the rubber material.

Recently, the polyester film surface has been designed in various ways, and in some type of films the winding conditions for the films is variable depending on the hardness and surface property of the touch roll. Therefore, the configuration of the resultant film roll depends on the hardness and surface property of the touch roll.

The inventors of the present invention considered that the hardness and surface condition of the touch roll should be adjusted in consideration of the surface condition of the film roll to be produced. On the basis of the above-mentioned consideration, the method of the present invention was completed.

SUMMARY OF THE INVENTION

As herein described, There is provided a process for producing a polyester film roll by winding a polyester film having a thickness not greater than 25 microns and a centerline average surface roughness (Ra) of from 0.001 to 0.05 microns; the improvement for preventing the formation of wrinkles in the film roll over a long period of storage, comprising controlling the hardness (H) of the film roll to a value satisfying the relationship:

$$H \geqq 0.67x^3 - 10.61x^2 + 55.54x - 1.16$$

wherein $x = ln\ (1/Ra)$, by bringing a touch roll into contact with the film roll in accordance with a surface-center-winding method, said touch roll having a peripheral surface hardness (F) satisfying the following relationships (II) and (III):

$$F \leqq 239.14 \times (Ra)^{0.28} \text{ when } Ra \leqq 0.044 \text{ microns} \quad \text{(II)}$$

and $$F \leqq 100 \text{ when } Ra > 0.044 \text{ microns} \quad \text{(III).}$$

DETAILED DESCRIPTION OF THE INVENTION

Figure 1:
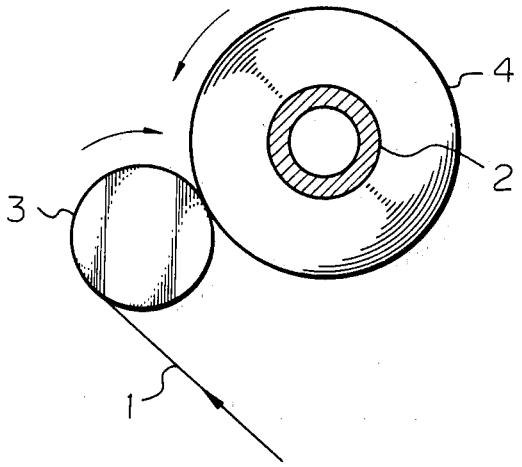
FIG. 1 is an explanatory side view of a film-winding machine usable for the method of the present invention.

In the method of the present invention, a polyester film is wound into the form of a film roll by means of a surface-center-winding method or a surface-winding method.

The winding procedure is carried out by using a film-winding machine, for example, as indicated in FIG. 1. Referring to FIG. 1, a polyester film 1 is fed from a film supply roll (not shown in FIG. 1) and is wound around a core 2 through a touch roll 3 so as to form a film roll 4. When the winding procedure is carried out in accordance with the surface-center-winding method, the core 2 is connected to a motor (not shown in FIG. 1) and is rotated at a predetermined peripheral speed, so as to cause the touch roll 3, which is free from the motor, to rotate at the same peripheral speed as that of the resultant film roll 4.

When the winding procedure is carried out in accordance with the surface-winding method, the touch roll 3 is connected to a motor (not shown in FIG. 1) and is rotated at a predetermined peripheral speed, so as to cause the resultant film roll 4 on the core 2 to rotate at the same peripheral speed as that of the touch roll 3. The core 2 may be connected to a motor (not shown in FIG. 1) and may be rotated at the same peripheral speed as that of the touch roll 3. Otherwise, the core may be free from the motor and may be rotated by the friction between the touch roll 3 surface and the resultant film roll 4 surface. The hardness of the film 1 may be adjusted by varying the tension therein, by varying the speed of the core 2 and touch roll 3 as mentioned above, or by means of an idler roll (not shown) bearing laterally against the film 1 upstream of the touch roll 3.

The polyester film roll of the present invention consists of a polyester film having a thickness of 25 microns or less, preferably 16 microns or less, and a centerline average surface roughness of from 0.001 to 0.05 microns.

In the case of a polyester film roll made from a film having a large thickness of more than 25 microns, substantially no wrinkles are formed in the film roll during a long period of storage. However, when the film has a small thickness of 25 microns or less, wrinkles are formed in the resultant film roll during a long period of storage, and the wrinkles formed in the roll become permanent and set during storage. A film having wrinkles is useless. Especially, in the case where polyester film is used as a base film of a magnetic tape, the wrinkles formed in the film render the film useless.

The present invention is effective for producing a polyester film roll consisting of a very thin polyester film being free from wrinkles.

The centerline average surface roughness of the polyester film can be determined in accordance with Japanese Industrial Standard (JIS) B 0601-1976.

The polyester film usable for the present invention must exhibit a centerline average surface roughness of from 0.001 to 0.05 microns. If the centerline average surface roughness of the film is more than 0.05 microns, that is, if the friction created between the film layers in the film roll is small, the film layers can easily slip on each other. In this case, the partial elongation of the film layers due to the absorption of moisture can be absorbed without forming wrinkles by the slippage on the film layers each other.

However, the small friction between the film layers in the film roll causes the film layers to easily slip on each other and therefore, the film roll is easily deformed.

In the case where the polyester film has a centerline average surface roughness (Ra) of less than 0.001 microns, that is, an extremely high smoothness, it is difficult for the layers of film in the film roll to slip on each other because of an extremely large friction between the film layers and because the film layers partially adhere to each other, thereby causing a blocking phenomenon to take place between the film layers. When this type of film roll absorbs moisture from the ambient atmosphere through the peripheral surface and the side faces of the film roll, the absorption off moisture results in partial elongation of the film. However, the partial elongation of the film is hindered by the blocking phenomenon which takes place between the film layers. Therefore, the absorption of moisture does not result in the formation of wrinkles in the film roll.

Also, when a film having a small centerline average surface roughness (Ra) is wound up, the layers of the film are allowed to adhere to each other by making the thickness of the air layers formed between the film layers as small as possible. This type of film roll is highly resistant to the penetration of moisture into the film roll. Accordingly, this type of film roll is also highly resistant to the formation of winkles in the film roll.

However, it is very difficult to process or handle polyester film having a small centerline average surface roughness (Ra) of less than 0.001 microns due to the extremely large friction coefficient of the film.

Accordingly, a polyester film having a centerline average surface roughness (Ra) of from 0.001 to 0.05 microns can be easily processed or handled and is adequate for forming a film roll which is resistant to deformation.

However, a polyester film having a centerline average surface roughness (Ra) of from 0.001 to 0.05 microns is disadvantageous in that when the resultant film roll is stored for a long period of time in an ambient atmosphere containing moisture, wrinkles are formed in the film roll.

In the conventional technique for forming a film roll from the above-mentioned type of polyester film, the above-mentioned disadvantage can be removed merely by allowing the entire film to absorb moisture before the film is wound or by decreasing the roll hardness of the film roll so as to allow the film layers in the film roll to move on each other without forming wrinkles.

However, the former method of preliminarily absorbing moisture is disadvantage in that a very long time is required for the entire film to absorb moisture and thus cannot be practically used. Also, in the later method, the decreased roll hardness causes the resultant film roll to be easily deformed.

The roll hardness (H) of the film roll can be measured by using a hardness tester in such a manner that a steel ball is passed against the peripheral surface of the film roll. In the present invention, the roll hardness (H) of the film roll was measured in five different portions of the peripheral surface of the film roll and was represented by the average of the measured five hardness values.

The relationship between the center average surface roughness (Ra) of polyester film and the roll hardness of the film roll necessary for preventing the formation of wrinkles in the film roll over a long period of storage was investigated in the following manner.

Four different types of polyethylene terephthalate films, each having a thickness of 10 microns and the centerline average surface roughness (Ra) indicated in Table 1, were produced by means of a biaxial drawing process by using mixtures of polyethylene terephthalate and surface roughening materials, for example, kaoline, calcium carbide and silica powders, which differ from each other in particle size or amount thereof.

The films were wound up into film rolls by using a surface-center-winding machine. The pressures applied to the surface of the film roll by the touch roll and the tension applied to the film were varied so as to vary the roll hardness of the resultant film roll.

The resultant film rolls were allowed to stand for 7 days at a temperature of 35° C. and a relative humidity of 70%, and thereafter the film rolls were checked for the formation of wrinkles.

Table 1 shows the relationship between the centerline average surface roughness (Ra) of the film and the minimum roll hardness (H) of the film roll, at which hardness no wrinkles were formed in the film roll.

TABLE 1

| Centerline average surface roughness Ra (μ) | Minimum Hardness H |
|---|---|
| 0.05 | <88 |
| 0.03 | <92 |
| 0.01 | <95 |
| 0.001 | <97 |

Table 1 clearly shows that the smaller the centerline average surface roughness (Ra) of the film, the larger the roll hardness (H) of the film roll necessary for preventing the formation of wrinkles.

The centerline average surface roughness (Ra) of the film and the roll hardness (H) of the film roll should be adjusted so as to satisfy the relationship (I):

$$H \geqq 0.67x^3 + 10.61x^2 + 55.54x - 1.16$$

wherein $x = \ln(1/Ra)$.

If the value of the roll hardness does not satisfy the relationship (I), the resultant film roll is disadvantageous in that wrinkles are easily formed in the film roll and in that the film roll is easily deformed during a long period of storage.

The storage roughness of the polyester film can be adjusted to a desired value by adding a surface-roughening material which serves as nucleae for forming the roughened surface or from which the surface-roughening nucleae are formed to the film-forming polyester matrix.

The surface-roughening material may consist of at least one member selected from the group consisting of the residue of a catalyst used to produce the polyester.

In the method of the present invention, the winding procedure for the specific polyester film is carried out by means of the surface-center-winding method in which a touch roll is placed on the surface of the film roll so as to control the amount of air in the air layers formed between the film layers and so as to cause the resultant film roll to satisfy the relationship (I) between the roll hardness and the centerline average surface roughness. When the roll hardness of the film roll is made large, that is, when the film is wound up tightly, the layers of film in the film roll are strongly pressed against each other. If a small dust particle or fluff comes into contact with the smooth surface of the film, the small dust particle or fluff adheres to the surface of the film having a large coefficient of friction. When the film is wound up together with the adhering dust particle or fluff, the dust particle or fluff forms a small primary pimple (protuberance). When the film layer is placed on the pimple, a secondary pimple which is larger than the primary pimple is formed on the film layer. That is, the size of the pimple (protuberance) increases as the number of film layers superimposed on the primary pimple (protuberance) increases. In this case, a film roll having a pimple is commercially useless.

Also, when the surface of the polyester film has an extremely high smoothness, the surface exhibits an enhanced adhering property. Accordingly, when the film is wound up, the film layers adhere to each other so as to produce a blocking phenomenon between the film layers. This phenomenon causes the formation of pimples or protuberances, in the film roll. The formation of pimples can be prevented by adjusting the hardness of the peripheral surface layer of the touch roll to an adequate value.

For example, five different types of polyethylene terephthalate films, each having a thickness of 12 microns, a width of 600 mm and the centerline average surface roughness indicated in Table 2, were wound up by using a slit-center-winding machine at a winding speed of 200 m/min and winding tension of 1.0 kg/mm$^2$. In this winding procedure, a touch roll was placed on the surface of the film roll so as to press the film roll under a pressure of 60 kg/60 cm. The hardness of the peripheral surface layers in the touch roll was varied at a number of levels. After the winding procedure was completed, the peripheral surface of the film roll was observed to determine whether pimples had formed on the peripheral surface. From the above-mentioned observation, the maximum hardness of the peripheral surface layer in the touch roll at which no pimples were formed was determined. The results are indicated in Table 2.

TABLE 2

| Centerline average surface roughness (Ra) of the film (microns) | Maximum hardness of the touch roll surface for preventing formation of pimples |
|---|---|
| 0.05 | 100 degrees |
| 0.03 | 90 degrees |
| 0.02 | 80 degrees |
| 0.01 | 65 degrees |
| 0.001 | 35 degrees |

Table 2 shows that when the centerline average surface roughness of the film is small, the hardness of the peripheral surface layer in the touch roll should be small.

A touch roll provided with a peripheral surface layer having a hardness adequate for the film to be wound is effective for controlling the amount of air in the air layers formed between the film layers and for adjusting the roll hardness to a value satisfying the relationship (I).

The surface hardness (F) of the peripheral surface layer in the touch roll preferably satisfies the relationships (II) and (III):

$$F \leqq 239.14 \times (Ra)^{0.28} \text{ when } Ra \leqq 0.044 \quad \text{(II)}$$

and $$F \leqq 100 \text{ when } Ra > 0.044 \quad \text{(III).}$$

The surface hardness F of the touch roll can be measured by using hardness tester in such a manner that a steel ball is pressed against the peripheral surface of the touch roll.

The polyester film roll of the present invention is free from the formation of wrinkles over a long period of storage. Accordingly, the polyester film roll of the present invention is useful as a base film roll for magnetic tape or metallized film.

Examples of the present invention are illustrated below.

EXAMPLE 1

A polyester film was produced from a mixture of 99.5% by weight of polyethylene terephthalate and 0.5% by weight of clay particles having an average size of 0.6 microns by means of the usual melt-extruding-biaxial drawing process. The resultant film had a thickness of 8 microns and a centerline average surface roughness (Ra) of 0.04 microns. The film was cut a width of 650 mm and wound up by means of a slit-winding machine at a winding speed of 150 m/min to form a film roll having a roll length of 6,000 meters. The winding procedure was carried out under a winding tension of 1.2 kg/mm$^2$ and under a pressure of 80 kg/650 mm of a touch roll. The touch roll had a peripheral surface hardness of 85 degrees.

The resultant film roll had a roll hardness of 98 degrees. The film roll was stored for 7 days at a temperature of 40° C. and a relative humidity of 75%. No wrinkles were found in the stored film roll.

For the purpose of comparison, the same procedures as those mentioned above were carried out except that the pressure due to the touch roll was reduced to 20 kg/650 mm. The resultant film roll had a roll hardness of 88 degrees. After storage under the above-described conditions was completed the film roll contained wrinkles formed over a 1500 m length portion from the surface end of the film roll.

EXAMPLE 2

A polyester film having a thickness of 10 microns and a centerline average surface roughness of 0.025 microns was slit and wound by means of a slit-center-winding machine to form a film roll having a width of 650 mm and a roll length of 5,000 m. The winding procedure was carried out at a winding speed of 200 m/min under a winding tension of 1.0 kg/mm$^2$ while the surface of the film roll was pressed with a touch roll under a pressure of 60 kg/650 mm. The touch roll had a peripheral surface hardness of 75 degrees.

The resultant film roll exhibited a roll hardness of 96 degrees and no pimples were found in the film roll.

For the purpose of comparison, the same procedures as those described above were carried out except that the hardness of the peripheral surface of the touch roll was changed to 90 degrees. The resultant film roll had a roll hardness of 97 degrees. During the winding procedure, it was found that from the initial stage of the winding procedure, a number of pimples had formed in the film roll.

It was also found that in the case where the film roll had a roll hardness of 93 degrees or more, no wrinkles were formed in the film roll during the 7-day storing test described above.

EXAMPLE 3

The same procedures as those described in Example 2 were carried out except that the centerline average surface roughness of the polyester film and the peripheral surface hardness of the touch roll were changed to 0.013 microns and 50 degrees, respectively. The resultant film roll had a roll hardness of 95 degrees and contained no pimples.

However, in the case where the peripheral surface hardness of the touch roll was changed to 75 degrees, the resultant film roll had a roll hardness of 96 degrees and contained a certain number of pimples.

Also, it was found that in the case where the film roll had a roll hardness of 95 degrees or more, no wrinkles formed in the film roll during the 7-day storing test.

We claim:

1. In a process for producing a polyester film roll by winding a polyester film having a thickness not greater than 25 microns and a centerline average surface roughness (Ra) of from 0.001 to 0.5 microns; the improvement for preventing the formation of wrinkles in the film roll over a long period of storage, comprising controlling the hardness (H) of the film roll to a value satisfying the relationship:

$$H \geqq 0.67x^3 - 10.61x^2 + 55.54x - 1.16$$

wherein $x = ln\ (1/Ra)$, by bringing a touch roll into contact with the film roll in accordance with a surface-center-winding method, said touch roll having a peripheral surface hardness (F) satisfying the following relationships (II) and (III):

$$F \leqq 239.14 \times (Ra)^{0.28} \text{ when } Ra \leqq 0.044 \text{ microns} \quad \text{(II)}$$

and $$F \leqq 100 \text{ when } Ra > 0.044 \text{ microns} \quad \text{(III).}$$

2. A polyester film roll having improved storage characteristics, said roll being made by winding a polyester film having a thickness not greater than 25 microns and a centerline average surface roughness (Ra) of from 0.001 to 0.05 microns; and controlling the hardness (H) of the film roll to a value satisfying the relationship:

$$H \geqq 0.67x^3 - 10.61x^2 + 55.54x - 1.16$$

wherein $x = ln\ (1/Ra)$, by bringing a touch roll into contact with the film roll in accordance with a surface-center-winding method, said touch roll having a peripheral surface hardness (F) satisfying the following relationships (II) and (III):

$$F \leqq 239.14 \times (Ra)^{0.28} \text{ when } Ra \leqq 0.044 \text{ microns} \quad \text{(II)}$$

and $$F \leqq 100 \text{ when } Ra > 0.044 \text{ microns} \quad \text{(III).}$$

* * * * *